US012006004B2

(12) United States Patent
Peter

(10) Patent No.: US 12,006,004 B2
(45) Date of Patent: Jun. 11, 2024

(54) WATER SKI

(71) Applicant: Lorenz Roland Peter, Aigen-Schlägl (AT)

(72) Inventor: Lorenz Roland Peter, Aigen-Schlägl (AT)

( * ) Notice: Subject to any disclaimer, the term of this patent is extended or adjusted under 35 U.S.C. 154(b) by 246 days.

(21) Appl. No.: 17/618,127

(22) PCT Filed: Mar. 25, 2020

(86) PCT No.: PCT/AT2020/060130

§ 371 (c)(1),
(2) Date: Dec. 10, 2021

(87) PCT Pub. No.: WO2020/257832

PCT Pub. Date: Dec. 30, 2020

(65) Prior Publication Data

US 2022/0274674 A1 Sep. 1, 2022

(30) Foreign Application Priority Data

Jun. 25, 2019 (AT) ..... A 50562/2019

(51) Int. Cl.
*B63B 34/56* (2020.01)
*B63H 11/08* (2006.01)

(52) U.S. Cl.
CPC ..... *B63B 34/56* (2020.02); *B63H 11/08* (2013.01)

(58) Field of Classification Search
CPC ..... B63H 11/00; B63H 11/02; B63H 11/08; B63B 34/00; B63B 34/50; B63B 34/56; B63B 34/565; B63B 32/00; B63B 32/10; B63B 32/30; A63C 2203/00; A63C 2203/12; A63C 2203/50
USPC ..... 441/65, 68, 70, 76
See application file for complete search history.

(56) References Cited

U.S. PATENT DOCUMENTS

| | | | | |
|---|---|---|---|---|
| 3,113,550 | A | 12/1963 | Omer | |
| 3,144,849 | A * | 8/1964 | Maser | B63B 32/10 114/55.54 |
| 3,646,905 | A | 3/1972 | Martinmaas | |
| 3,812,813 | A | 5/1974 | Dickson | |
| 5,643,029 | A | 7/1997 | Rokofsky | |
| 11,767,085 | B2 * | 9/2023 | Rudofsky | B63B 32/10 440/6 |

(Continued)

FOREIGN PATENT DOCUMENTS

| | | |
|---|---|---|
| DE | 29919545 U1 | 2/2000 |
| EP | 0169818 A1 | 10/1986 |
| WO | 2013/149130 A1 | 10/2013 |

*Primary Examiner* — Daniel V Venne
(74) *Attorney, Agent, or Firm* — Tiajoloff & Kelly LLP

(57) ABSTRACT

The invention relates to water ski (1) having a buoyant ski body (2), to which, in addition to a binding (3), a propelling drive is assigned, which comprises a rotary drive unit with a rotary drive (4) and a screw drive which can be driven thereby, and having a control device (6) for presetting a drive power. In order to create advantageous drive conditions, it is proposed that the water skis (1) of a pair of water skis each comprise a rotary drive unit with at least one drive sensor (7) each, an associated energy storage device and a communication device, which adjusts the rotary drives (4) of both water skis (1) as a function of drive sensor data and preset data of the control device (6).

16 Claims, 2 Drawing Sheets

(56) References Cited

U.S. PATENT DOCUMENTS

Figure 1:
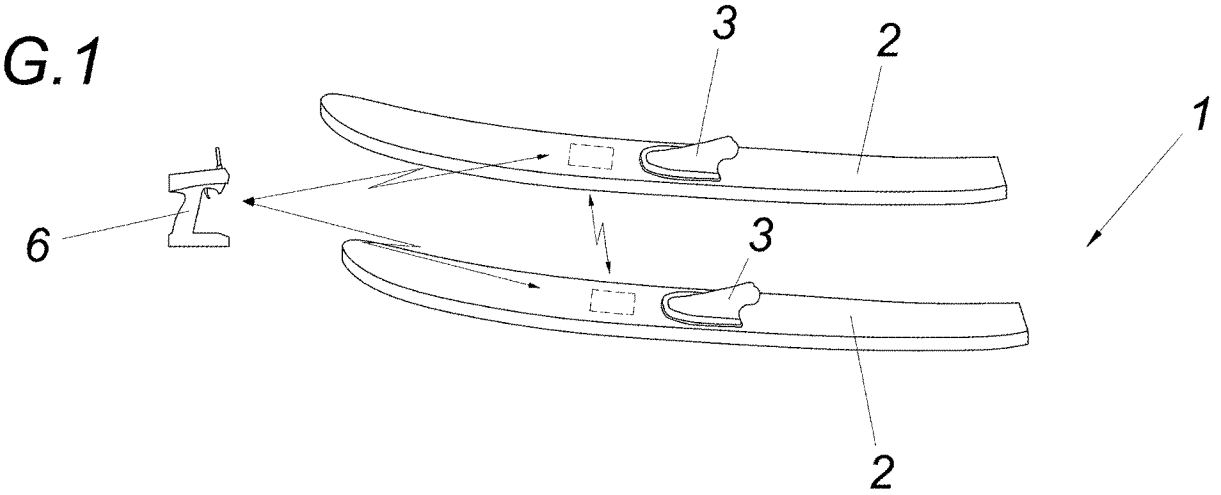

| | | | | |
|---|---|---|---|---|
| 11,787,513 | B2 * | 10/2023 | Rudofsky | B63B 34/10 440/6 |
| 2013/0282216 | A1 | 10/2013 | Edny | |
| 2015/0352430 | A1 | 12/2015 | Treadway et al. | |

* cited by examiner

WATER SKI

FIELD OF THE INVENTION

The invention relates to water skis having a buoyant ski body to which, in addition to a binding, a propelling drive is assigned, which comprises a rotary drive unit with a rotary drive and a screw drive which can be driven thereby, and having a control device for presetting a drive power.

DESCRIPTION OF THE PRIOR ART

Such motorized water skis, which can be used on waterways without a towing boat or water ski lift, are known from the U.S. Pat. Nos. 3,646,905 A, 3,113,550 A and EP 0169818 A1, for example. The device known from EP 0169818 A1 comprises water skis with a propeller drive, wherein the drive is provided by a motor arranged in a backpack, which is drive-connected to the propeller shaft via a flexible shaft.

With water skis that are buoyant, it is common for the water ski stern to sink under water when the skier, who is equipped with a life jacket, is in a seated position, whereas the shovel-shaped ski tips protrude above the water surface. When the skier actuates the control system, the rotary drive turns up the screw drive, a ship's propeller or a jet drive and accelerates the skis. As a result of the buoyancy of the water skis, which increases with speed, they float up to the water surface until they enter a gliding phase, after which the skier can assume his or her riding position with an upright upper body and slightly bent knees.

A surfboard-like device with drive is disclosed by DE 29919545 U1. U.S. Pat. No. 3,646,905 A is similar in design to a catamaran with an outboard engine arranged between the hulls. In U.S. Pat. No. 3,113,550 A it is provided to suck in water under the skis, feed it through pipes to a backpack and discharge the water for propulsion from the back of the backpack. A major disadvantage of the backpack solutions is that it considerably restricts the freedom of movement during the ride.

SUMMARY OF THE INVENTION

The invention is thus based on the object of creating water skis of the type described above, which do not restrict the skier's freedom of movement and which are equipped with an intelligent control system that defuses dangerous driving conditions.

The invention solves the set object in that the water skis of a pair of water skis each comprise a rotary drive unit having at least one drive sensor each, an associated energy storage device and a communication device which adjusts the rotary drives of both water skis as a function of drive sensor data and preset data of the control device.

This creates water skis that do not restrict the skier's freedom of movement. The two water skis are each equipped with a preferably electric motor or combustion engine, a propeller or jet drive and all components necessary for propulsion. In order to avoid dangerous driving conditions, the communication devices, which represent an interface between the control device and the rotary drive units, balance the rotary drives of both water skis depending on drive sensor data and on preset data of the control device. The drive sensor can be, for example, a speed sensor, a torque sensor for determining the drive power or a force sensor for measuring the drive thrust of the rotary drive unit or the like. The speed can be preset by a control device designed as a handle, which is connected, for example, wirelessly via a radio network to the communication devices of the two skis. In order to provide fully functional and non-movement-restricting motorized water skis, an intelligent communication system is required by means of which the two rotary drive units can communicate with each other to enable safe and stable riding. This minimizes the risk of accidents, as the motorized water skis make controlled movements and uncontrollable driving conditions can be prevented.

In order to create advantageous, particularly compact and the safest possible drive conditions, it is proposed that the rotary drive unit is a jet drive, the outlet nozzle of which is arranged in the area of the water ski end in the region of a water line. The outlet nozzle of the jet drive can be mounted on a jet drive body so that it can pivot around at least one axis, in order to be able to trim the water skis, if necessary, according to the skier's ability. This adjustment can be fixed. If a readjustment during operation is to be possible, the outlet nozzle of the jet drive can be mounted on a jet drive body so as to be pivotable about at least one axis by means of an actuator which can be adjusted depending on preset data of the control device.

The water skis can be equipped with a sensor measuring at least one angle of inclination about the longitudinal axis of the water ski to detect the position of the water skis on water.

Possible sensors for the detection of the position of the water skis on water are for example inertial sensors, acceleration sensors, gyro sensors, inclination or angle sensors and the like. For example, if the water skier wants to make a left turn, he leans to the left and rides to the left. If the sensors on both skis now detect that a certain tipping angle to the left is dictated by the skier, the right ski can be accelerated in relation to the left ski, for example, to make turning easier. With an acceleration sensor it is also possible to detect the speed at which a movement is made, i.e. it is detected whether, for example, tight turns are desired to be made, as is usual in the sports of surfing or water skiing. Changes in direction of travel can also be carried out or supported by a corresponding control of the outlet nozzle with the assigned actuator.

The two skis constantly communicate with each other via the communication devices, preferably wirelessly, for example via a Bluetooth connection.

Water skis can also be fitted with various sensors, for example to detect water ingress into one of the skis or unplanned temperature changes, speed changes and other changes in the motor, so that the skis can be constantly monitored to avoid dangerous skiing conditions for the skier. The communication between the skis immediately detects if the data of the two skis differ and as a consequence, if necessary, an intervention can be made or an emergency operation can be initiated. If, for example, the speed or temperature of one ski is too high, among other things, the speed of both skis can be automatically reduced to a correspondingly equal and lower level. Other safety sensors, such as a water contact sensor, can be used to determine whether or not a ski is in contact with water during the ride and the speed of the skis or one ski can be automatically adjusted.

Another safety measure is the use of emergency stop switches in case of a fall. For this purpose, a contact sensor can be provided in the binding, or a cuff fixed to the body can be connected to the water ski via a rip cord. If the skier falls, the rip cord is released from the skis and the rotary drive is immediately switched off.

Water skis can also be equipped with a position sensor to detect the mutual position on the water. If the distance between the two skis changes, laterally or as a result of a longitudinal offset, this should in particular be detected and, if necessary, corrected by appropriate control of the drive thrust or the outlet nozzle. There are several possibilities for such position sensors, e.g. gyro sensors which detect position changes, which can be compensated accordingly. In addition, the skis can also be equipped with DGPS sensors to correct corresponding mutual position changes. Solutions with strong magnets, camera solutions, echo sounder etc. are also conceivable. With the help of a force and/or pressure sensor assigned, for example, to the binding, in particular the binding base plate, it is possible, for example, to detect when the water skier exerts pressure to the left, right, back or front. In other words, if the water skier gets into a position where he or she could fall, for example due to waves, this is detected by the sensor data and can be counteracted accordingly. If the skier wants to move the left ski a little further back, for example to initiate a turn, they push the ski backwards and this is detected by the sensor and thus the left ski becomes slower than the right until the sensor has the normal load collective again. The movement is thus supported. The same principle also works with speed sensors. If, for example, the left ski becomes slower, the sensor detects that the skier is braking the ski, i.e. wants to get the ski further back. This movement is supported by slowing down the respective ski until the speed is the same as the other ski.

For beginners, or for learning the device, it can be advantageous if the water skis can be mechanically connected to a coupling device. The rotary drives of both water skis are then preferably to be rigidly coupled or synchronized. By means of the mechanical coupling device the water skis can be connected to a kind of monoski or surfboard, if necessary. With a mechanical coupling device, the skis can be easily connected and disconnected again. In particular the release can be carried out either by a switch using the remote control or manually, if necessary. This can make it easier to ride away out of the water, for example. If the skis are connected, it is much easier to position oneself over the skis and slip one's feet into the binding before the coupling device is released before or after riding away.

For a special riding experience, the water skis can be equipped with a hydrofoil, wherein the rotary drive units are preferably arranged in the area of the hydrofoil wings.

It is recommended that the communication device for reading out data be designed for wireless connection to a computer unit. In this way, programming, e.g. selection of an operating mode, can be carried out externally at any time.

In addition, a pair of ski poles may be associated with the pair of water skis, wherein the ski poles are equipped with floats at the end facing away from the grips and wherein at least one of the two ski poles is equipped with an actuating device for operating the control device.

It is possible to have a separate control device for each of the two water skis, one in the left and one in the right hand. The speed of the left ski can thus be controlled with the control device in the left hand and the right ski with the control device in the right hand.

This makes riding in curves particularly easy. As it is not possible to hit the speed of both skis exactly the same, it is possible to control both skis at the same time with one button on one of the two remote controls. The communication device avoids invalid, in particular dangerous riding conditions. If, for example, the skier wants one of the motorized water skis to go faster than the other, he can only increase the speed of one of them by a certain percentage of the current speed. A programmed lock prevents a ski from inadvertently going too fast, i.e. the skis drifting apart.

Basically, the body of motorized water skis is made of light material such as carbon or plastic, etc. In addition, the skis can consist of an inflatable body in which the drive technology with all its components is integrated. An essential advantage of this construction is that little storage space is required.

There are two variants of the construction, one of them is to design the motorized water skis in such a way that the skier floats on the water surface even when not in motion. The skis can therefore carry his body weight. The second variant is that the motorized water skis cannot carry the weight of the skier as long as he is not moving at a certain speed. Only when the water skis are moved over the water at a certain speed is the necessary buoyancy achieved to lift the skier out of the water. In order to improve the stability or the contact surface of the water skis with a few hand movements, to make it easier for children or beginners to ride them, it is suggested to provide a separate inflatable body, a kind of floating tire, which surrounds the respective water ski or into which the water ski can be inserted.

To increase the safety of water skis, a pressure sensor can be assigned to the binding, in particular a binding plate. As long as a skier exerts sufficient pressure on the pressure sensor, the skis can be operated in the desired manner. If this pressure ceases to exist as a result of a fall or the like, the rotary drives are switched to zero power or the binding is released in order to prevent the skis from continuing to move in an uncontrolled manner.

Furthermore, it is advantageous to assign a humidity sensor to the remote control. This sensor detects when the remote control is immersed in water in the event of a fall and in turn switches the rotary drive to zero power.

As a further additional function, a personalized unlocking mechanism can be provided to prevent unauthorized use of the water skis by third parties. With this unlocking mechanism it is possible, for example by means of a fingerprint sensor on the remote control or on the skis, to unlock the control system to ensure that the skis can only be operated by authorized persons.

BRIEF DESCRIPTION OF THE INVENTION

Figure 2:
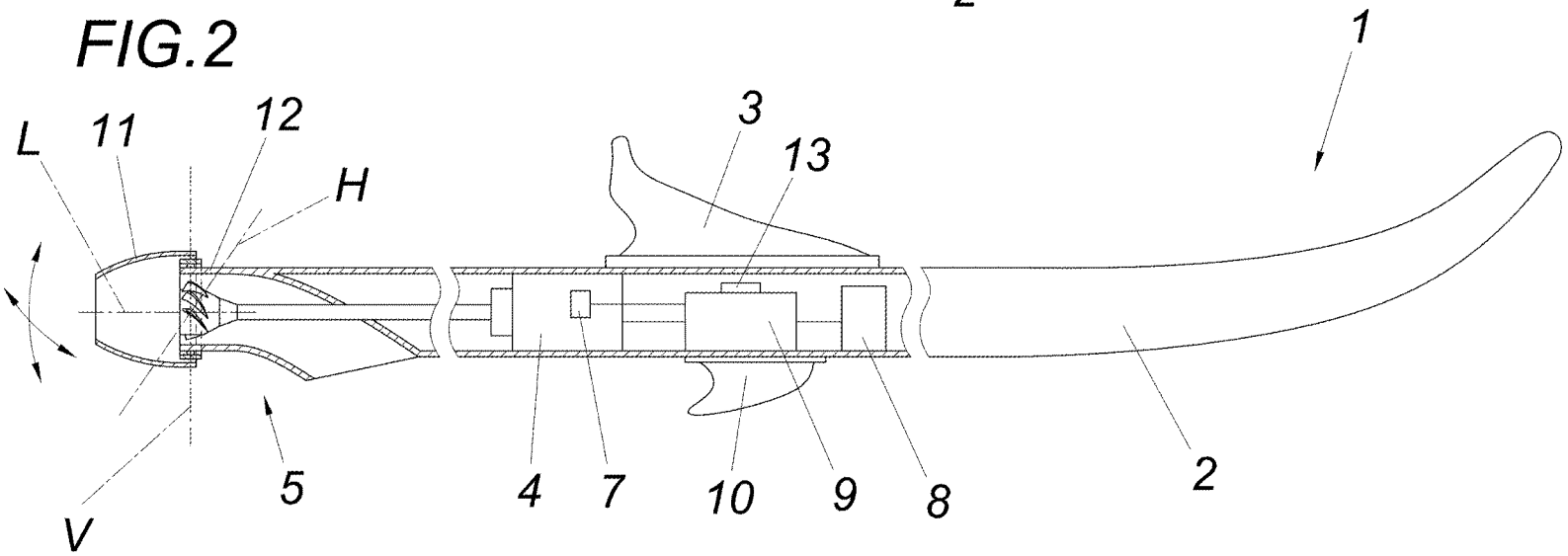
Figure 3:
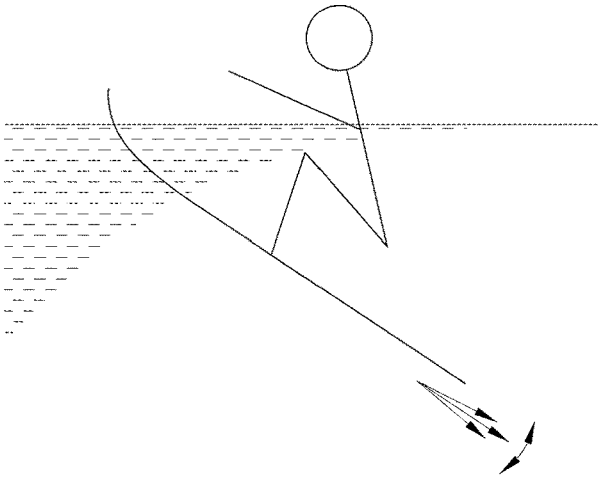
Figure 4:
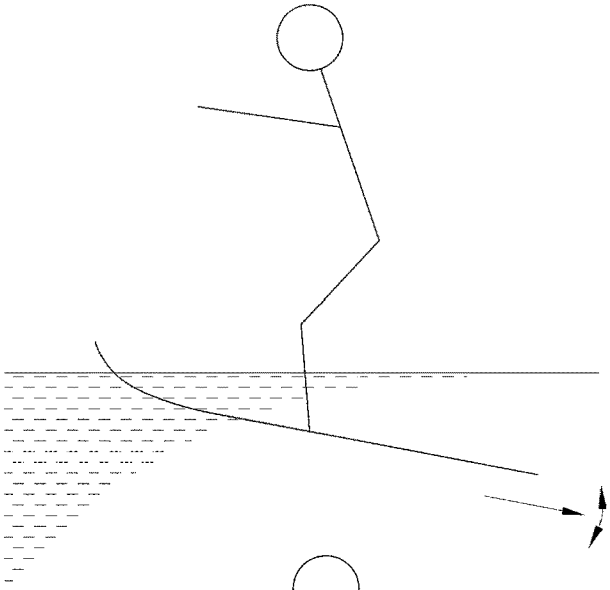
Figure 5:
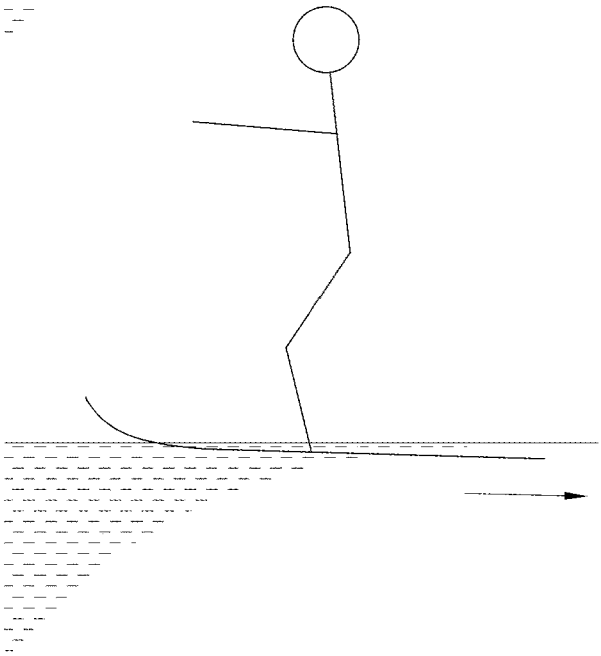

The subject matter of the invention is shown in the drawings by way of example, wherein:

FIG. 1 shows water skis according to the invention in a schematic diagonal view, FIG. 2 shows a water ski in a partly cut side view, and FIGS. 3 to 5 show a possible motion sequence during a start procedure.

DESCRIPTION OF THE PREFERRED EMBODIMENTS

The water skis 1 of a pair of water skis each comprise a buoyant ski body 2, to which, in addition to a binding 3, a propelling drive is assigned, which comprises a rotary drive unit with a rotary drive 4, an electric motor, and a screw drive which can be driven by it, in the embodiment example a jet drive 5. In addition, a control device 6 is provided for setting a drive power.

The water skis 1 of the water ski pair each comprise a rotary drive unit with at least one drive sensor 7 each, for example a speed sensor or the like, an associated energy storage device 8, a battery pack and a communication device 9. The communication device 9 adjusts the rotary drives 4 of both water skis 1 as a function of drive sensor data and preset data of the control device 6 and controls the water skis 1 accordingly, e.g. for starting, for a turn or for speed changes. For this purpose, the communication devices 9 of both water skis 1 communicate accordingly via a radio link, for example via Bluetooth. For stabilization, a fin 10 is arranged on the underside of the water ski, below the binding 3, on the water ski 1.

The outlet nozzle 11 of the jet drive 5 is arranged in the area of the water ski end in the region of a waterline. In addition, the outlet nozzle 11 can be pivotably mounted about at least one axis H, V on a jet drive body 12. For this pivoting adjustment, an actuator (not shown in more detail) can be provided, by means of which the outlet nozzle 11 is mounted on a jet drive body 12 so as to be mounted in a pivotably adjustable manner as a function of preset data of the control device 6. The jet drive 5 sucks in the water to be discharged in the usual manner in front of its propeller (impeller) on the underside of the water ski and discharges it via a nozzle to generate the drive thrust behind the propeller (impeller).

In addition, the water skis 1 are equipped with an inclination angle sensor 13 measuring at least one angle of inclination around the water ski longitudinal axis L to detect the position of the water skis on the water.

In a possible starting position, the water skier equipped with a life jacket sits in the water with skis strapped on (FIG. 3). In this case, the water ski stern sinks under water, whereas the shovel-shaped ski tips protrude above the water surface.

If the skier operates the control device 6 by hand, the rotary drive 4 turns up the screw drive of the jet drive 5 and accelerates the skis, wherein the skier initially remains in a sitting position with his body weight shifted forwards. In this case, the pivotably adjustable nozzle can ensure stability by pivoting around the corresponding axis depending on the speed of travel to provide more or less additional buoyancy. Depending on whether the jet stream is intended to press the ski end under water or lift it out of the water (FIG. 4). As a result of the buoyancy of the water skis 1, which increases with increasing speed, they float up to the water surface until they enter a gliding phase, after which the skier can take up his riding position with an upright upper body and slightly bent knees (FIG. 5). In this position, the pivotably adjustable nozzles can be used to support changes in direction of travel by deflecting them accordingly.

The invention claimed is:

1. A water ski comprising:

a buoyant ski body having a binding and a propelling drive associated therewith;

wherein said propelling drive comprises a rotary drive unit with a rotary drive and a screw drive driven thereby, said propelling drive further having a control device presetting a drive power;

wherein the water ski is configured so that the water ski can be combined with another water ski that has a respective rotary drive and a respective control device so as to form a pair of water skis; and wherein the rotary drive unit of each of said water skis has at least one drive sensor, an associated energy storage device, and a communication device adjusting the respective rotary drive of both of said water skis based on drive sensor data and preset data of the respective control device.

2. The water ski according to claim 1, wherein the rotary drive unit is a jet drive with an outlet nozzle arranged in an area of an end of the water ski in a region of a water line.

3. The water ski according to claim 2, wherein the outlet nozzle of the jet drive is mounted on a body of the jet drive so that the jet drive pivots about at least one axis.

4. The water ski according to claim 3, wherein the outlet nozzle of the jet drive is mounted on a jet drive body so that the let drive pivots about at least one axis by an actuator that is adjusted as a function of the preset data of the control device.

5. The water ski according to claim 1, wherein the water ski is equipped with a sensor measuring at least one angle of inclination about a longitudinal axis of the water ski so as to detect a position of the water ski on water.

6. The water ski according to claim 1, wherein the binding has a binding plate, and is equipped with a pressure sensor detecting when a fall of a user has occurred.

7. The water ski according to claim 1, wherein the water ski is equipped with a position sensor detecting a mutual position of the pair of water skis on the water.

8. The water ski according to claim 1, wherein the water ski is configured such that the water ski can be mechanically connected to a coupling device connecting with the other water ski of the pair of water skis.

9. The water ski according to claim 1, wherein the communication device can be wirelessly coupled to a computer unit for reading out data.

10. The water ski according to claim 4, wherein the water ski is equipped with a sensor measuring at least one angle of inclination about a longitudinal axis of the water ski so as to detect a position of the water ski on water.

11. A water ski system, comprising:

a pair of water skis each including a respective buoyant ski body having a binding for a foot of a user, and a propelling drive supported on the ski body;

said propelling drives each including a respective rotary drive unit with a rotary drive driving a screw drive, and said propelling drives each having a respective control device associated therewith controlling a drive power thereof; and wherein the rotary drive units have respective drive sensors, respective energy storage devices, and respective communication devices adjusting operation of the respective rotary drive of both of said water skis based on data of the drive sensor and stored preset data via the respective control device.

12. The water ski system according to claim 11, wherein each of the rotary drive units is a jet drive with an outlet nozzle arranged in an area of an end of the associated water ski in a region of a water line, the outlet nozzle of the jet drive being mounted on a body of the jet drive so that the jet drive pivots about at least one axis responsive to an actuator based on some of the preset data of the respective control device.

13. The water ski system according to claim 11, wherein the water skis are each equipped with a respective sensor measuring at least one angle of inclination of the water ski about a respective longitudinal axis of the water ski so as to detect positions of the water skis on water.

14. The water ski system according to claim 11, wherein the binding has a pressure sensor detecting when a fall of a user has occurred.

15. The water ski system according to claim 11, wherein the water skis have a position sensor detecting a mutual position of the pair of water skis relative to each other on the water.

16. The water ski system according to claim 11, wherein the water skis are mechanically connected by a coupling device.

* * * * *